US011920895B2

(12) United States Patent
Calvete

(10) Patent No.: US 11,920,895 B2
(45) Date of Patent: Mar. 5, 2024

(54) BOLT ACTION FIREARM HAVING AN EXTRACTOR AND A PROPELLANT CHARGE CASE ADAPTED FOR EXTRACTION, AND METHOD OF EXTRACTING

(71) Applicant: Ardesa, S.A., Zamudio-Vizcaya (ES)

(72) Inventor: Angel Calvete, Zamudio-Vizcaya (ES)

(73) Assignee: Ardesa, S.A., Zamudio-Vizcaya (ES)

( * ) Notice: Subject to any disclaimer, the term of this patent is extended or adjusted under 35 U.S.C. 154(b) by 0 days.

(21) Appl. No.: 17/467,857

(22) Filed: Sep. 7, 2021

(65) Prior Publication Data

US 2022/0099417 A1 Mar. 31, 2022

Related U.S. Application Data

(60) Provisional application No. 63/075,553, filed on Sep. 8, 2020.

(51) Int. Cl.

| | |
|---|---|
| ***F42B 5/26*** | (2006.01) |
| ***F41C 9/08*** | (2006.01) |
| *F42B 5/10* | (2006.01) |

(52) U.S. Cl.
CPC . *F41C 9/08* (2013.01); *F42B 5/10* (2013.01)

(58) Field of Classification Search
CPC ..... F42B 5/26; F42B 5/28; F42B 5/32
See application file for complete search history.

(56) References Cited

U.S. PATENT DOCUMENTS

| | | | | |
|---|---|---|---|---|
| 2,294,822 | A * | 9/1942 | George | F42B 5/285 102/464 |
| 2,831,287 | A * | 4/1958 | Maillard | F41A 21/12 42/76.01 |
| 4,232,468 | A | 11/1980 | Chapin | |
| 4,454,817 | A * | 6/1984 | Bockstruck | F42B 5/26 42/76.01 |
| 5,048,421 | A * | 9/1991 | Swartout | F42B 5/18 102/431 |
| 5,822,904 | A | 10/1998 | Beal | |
| 7,726,245 | B2 | 6/2010 | Quesenberry | |
| D625,380 | S | 10/2010 | Walter | |
| 9,046,332 | B2 | 6/2015 | Peterson | |
| 9,157,713 | B1 | 10/2015 | Peterson | |
| 9,329,003 | B2 | 5/2016 | Peterson | |
| 9,377,277 | B1 | 6/2016 | Worrell, Jr. | |
| 9,562,754 | B2 | 2/2017 | Peterson | |
| 10,030,956 | B2 | 6/2018 | Peterson | |
| 10,254,092 | B1 | 4/2019 | Worrell, Jr. | |
| 11,137,224 | B2 * | 10/2021 | Calvete | F41A 9/70 |
| 2002/0129531 | A1 | 9/2002 | Camp | |

(Continued)

*Primary Examiner* — Derrick R Morgan
(74) *Attorney, Agent, or Firm* — DeLio Peterson & Curcio LLC; Brian G. Schlosser

(57) ABSTRACT

A propellant charge used in a muzzleloading bolt action firearm having a cylindrical casing body for insertion within a breech end of a barrel. The casing body enclosing a propellant charge of predetermined amount, and having a base at the back end with a rim radially extending outwards with a forward surface facing the cylindrical body forward end and mounted flush with the barrel breech end upon insertion. A slot is formed proximate the rim to receive an extension or protrusion of an extractor for removal after firing when the bolt is moved away from the barrel.

17 Claims, 5 Drawing Sheets

(56) References Cited

U.S. PATENT DOCUMENTS

| | | | | |
|---|---|---|---|---|
| 2005/0183318 | A1 | 8/2005 | McGivern | |
| 2005/0257711 | A1 | 11/2005 | Husseini | |
| 2010/0275487 | A1 | 11/2010 | Quesenberry | |
| 2012/0005932 | A1 | 1/2012 | Szecsei | |
| 2018/0321022 | A1 | 11/2018 | Peterson et al. | |
| 2020/0378707 | A1* | 12/2020 | Shipley | F41A 21/12 |
| 2021/0055068 | A1* | 2/2021 | Calvete | F41C 9/08 |
| 2022/0099417 | A1* | 3/2022 | Calvete | F42B 5/26 |

* cited by examiner

BOLT ACTION FIREARM HAVING AN EXTRACTOR AND A PROPELLANT CHARGE CASE ADAPTED FOR EXTRACTION, AND METHOD OF EXTRACTING

BACKGROUND OF THE INVENTION

1. Field of the Invention

This invention relates generally to an ammunition system for firearms, specifically for accommodating propellant charges that are used in bolt action firearms, and more specifically for bolt action muzzleloading firearms. The invention relates to a propellant charge design that facilitates extraction in a bolt action system.

2. Description of Related Art

Like most early firearms, the first rifles were muzzleloading firearms. A muzzleloader is any firearm into which the projectile and usually the propellant charge is loaded from the muzzle of the gun (i.e., from the forward, open end of the gun's barrel). Unlike modern breech loaded firearms where the bullet, propellant charge, and primer are loaded as prepackaged cartridges, muzzleloaders are loaded by feeding a propellant charge through the muzzle of the barrel before ramming a bullet or projectile down the barrel with a ramrod until the bullet seats against the propellant charge at the breech end of the barrel.

There are generally three types of muzzleloading firearms: inline 209 primers and percussion, caplock, and flintlock muzzleloaders. Inline 209 primers and percussion muzzleloaders tend to look like most modern firearms. The inline and caplock muzzleloaders differ on where the nipple is attached. The nipple is the component that holds a percussion cap. In the center of the nipple, a small flash hole allows the spark from the cap to transfer to the main propellant charge. In an inline muzzleloader, the cap is in line with the hammer and the barrel. The inline design has the nipple attached to the barrel at the breech and is accessible by a bolt or break action. In addition, inline models may use a removable breech plug to facilitate cleaning. Caplock rifles have a side-mounted firing pin similar to the flintlock rifle, and operate and load in much the same way, but use a more modern pre-loaded firing cap to fire the rifle. A flintlock style of muzzleloader dates back to the 17th century and features a flintlock mechanism that produces sparks when a piece of flint strikes a steel frizzen.

Loading a traditional black powder muzzleloader firearm generally involves a certain amount of complexity (as compared to the loading of modern firearms). For loose granular powder, such general steps include: a) making sure the rifle is not primed; b) making sure the rifle bore is clean of fouling and oil; c) setting a powder measure for a desired powder charge; d) pouring the powder into the measure and then into the muzzle of the rifle; and e) using a ramrod, pressing the bullet, such as a patched round ball, through the rifling and down the bore until it contacts the powder charge.

The ammunition used in muzzleloading rifles has evolved from a round ball projectile compressed in the muzzle end with a patch to projectiles that have incorporated features of modern bullets. Within the latter category, bullet shaped projectiles can be further subdivided into those that are fired with a sabot (which replaces the patch), and projectiles that are lubricated slugs. A sabot is an encasing plastic cup that generally falls away from the projectile after it exits the gun.

The sabot eliminates the need for a lubricating means and assures that there is a good seal between the projectile and the bore of the barrel.

Current muzzle loading ammunition comprises multiple parts combined together when loaded into a firearm. Because the various parts are separate, they are not sealed, and they use pyrotechnic materials such as black powder or black powder substitutes that tend to be hygroscopic (they tend to absorb moisture from their surroundings and in particular absorb water vapor from the atmosphere). As a result, their efficiency degrades overtime, and the propellant and resultant combustion products tend to corrode the firearm barrel and chamber.

A complete round of ammunition consists of all the components necessary for one firing of the gun. These normally include a projectile, the propellant or bursting charge, and a primer that ignites the propellant. Other components such as a cartridge case and fuse complete the ammunition.

Variability in muzzleloaders not present in cartridge-based firearms is the quantity and type of the propellant charge. Unlike cartridge firearms, the bullet and propellant charge are combined within the firearm for firing. For muzzleloading firearms, multiple ammunition components are loaded from different ends of the barrel. These multiple components include at least a propellant charge and projectile. The propellant charges comprise a predetermined amount of black powder, black powder substitutes, or smokeless gunpowder. The projectile typically comprises a bullet with or without a sabot. The projectile and propellant charge are traditionally loaded in the muzzle end of the barrel.

Ammunition has evolved over the years, but some general terminology has remained constant, and the terms are used herein in their accepted fashion:

1. A cartridge is a single unit of ammunition; for a modern small arms cartridge, this is the combination of a bullet, propellant, primer and cartridge case in a single unit. The cartridge case is generally cylindrical in shape and includes an internal lumen. A propellant is contained within the lumen of the cartridge case. Ignition of the propellant provides the energy that propels the saboted bullet at a target;
2. A "round" is a term synonymous with a fully loaded cartridge containing a projectile, propellant, primer and casing; and
3. A "fixed round" is a round of ammunition which when stored outside of the firearm chamber prior to loading the round, has the propellant and the bullet commonly engaged to each other by direct engagement.

Various forms of ammunition have been proposed for muzzle loading ammunition. Such ammunition over the years evolved from round ball projectiles to ammunition that has incorporated many of the features of modern bullets. For example, U.S. Pat. No. 7,726,245 issued on Jun. 1, 2010, titled "MUZZLELOADER AMMUNITION," teaches a fixed round of ammunition for a muzzleloader firearm. The round has a bullet within a sabot that is engaged to a consumable cartridge case. The case is filled with propellant. The bullet is engaged to the propellant composition via the cartridge case. This "fixed round" attempts to incorporate fully modern bullet attributes. In contrast, the more typical muzzle loading ammunition comprises multiple parts that are combined together when loaded into a firearm.

U.S. Pat. No. 9,329,003 issued on May 3, 2016, titled "MUZZLELOADER SYSTEMS," teaches a pre-packaged propellant charge and primer for providing a means for loading and unloading of the muzzleloader. The breech end accepts the propellant, and a design constriction at the breech end of the barrel is provided to prevent breech loading of the projectile. A projectile inserted in the muzzle end seats on the constriction portion of the barrel. A containment vessel comprising an integrated primer and a cup portion with a propellant charge is insertable into the axial chamber of the breech plug to define the breech end of the barrel, wherein an integrated primer is positioned to be struck with the external hammer to fire the muzzleloader. Similarly, the containment vessel is removable from the axial chamber to unload the muzzleloader.

The ammunition has a predetermined amount of propellant charge encased in a housing or casing along with a separate muzzleloader projectile that when combined with the encased propellant charge presents an ammunition cartridge.

An issue with ammunition of this type is the removal of the casing containing the propellant charge after firing. Essentially, if the same casing used in a break open action rifle is also utilized in a bolt action rifle, the extraction of the casing becomes more challenging. The present invention addresses this issue.

SUMMARY OF THE INVENTION

Bearing in mind the problems and deficiencies of the prior art, it is therefore an object of the present invention to provide an ammunition component easily extractable from the barrel of a bolt action rifle.

There are many different bolt action platforms/styles including, but not limited to, Mauser-style action, Straight pull, Savage, Mosin-Nagant style, and Remington 700 style long and short actions. Certain embodiments of the present invention are well suited for rotating bolt actions. Another object of the present invention is solving the extraction issues around these platforms while maintaining a small diameter receiver. Effectively, the proposed propellant charge case greatly facilitates its use in bolt action rifles such as, for example, those utilizing Remington, Savage, and Mauser stocks.

It is another object of the present invention to provide a propellant charge case with a formed gap, slot, or aperture at the base end for receiving a portion of an extractor, such as an extractor extension or protrusion in a bolt-action rifle design.

A further object of the invention is to provide an ammunition system for a muzzleloading firearm that can seat flush against the barrel in a bolt action system, and be configured for removal by an extractor when the bolt head moves away from the barrel.

The above and other objects, which will be apparent to those skilled in the art, are achieved in the present invention which is directed to a propellant charge case for ammunition for a muzzleloading firearm having a barrel or barrel extension with a breech end and a muzzle end, the propellant charge case comprising: a cylindrical casing body having a forward end, a back end, and a central axis, the casing for insertion within the breech end of the barrel or barrel extension, the casing body enclosing a propellant charge of predetermined amount; a cap proximate the forward end of the casing body for sealing the propellant charge within the propellant charge case; a base at the back end of the casing body, the base having a top surface and a bottom surface, the base including: a cylindrical cavity receiving a primer or percussion cap; a central aperture extending from the cylindrical cavity to the propellant charge; a rim radially extending outwards from the central axis, the rim having a forward surface facing the cylindrical body forward end, the rim forward surface in contact with the barrel breech end or barrel extension breech end when the propellant charge case is inserted within the barrel breech end or the barrel extension breech end; and a gap located adjacent to, and axially distanced from, the rim forward surface in a direction of the base top surface, such that the gap is exposed outside the breech end or the barrel extension breech end when the propellant charge case is inserted within the barrel breech end or the barrel extension breech end.

The muzzleloading firearm is a bolt action firearm.

The gap may be formed between the rim forward surface and a disc extending radially from the central axis. The disc is formed at the base top surface.

The base includes an axially extending protrusion extending in a direction along the central axis away from the rim forward surface towards the base top surface, the axially extending protrusion terminating at the disc such that the gap is a circumferential slot.

The base axially extending protrusion has a diameter that is smaller than a diameter of the rim and smaller than a diameter of the disc, forming the slot.

The gap is configured to receive an extractor for removing the propellant charge case from the barrel breech end or the barrel extension breech end. The gap may be formed circumferentially around the base, centered about the central axis.

The cylindrical casing body may be fabricated of plastic material.

The propellant charge case may include a metal outer surface on at least a portion of the cylindrical casing body.

In a second aspect, the present invention is directed to a firearm and ammunition combination comprising: a rifle receiver; a barrel having a barrel breech end and a muzzle end, the muzzle end configured for receiving a projectile; the barrel breech end having a chamber to receive a cartridge or propellant charge case, wherein the chamber extends through the barrel breech end to a narrowing portion in the barrel, the narrowing portion having a smaller diameter than a largest diameter of the projectile, such that loading the projectile into the barrel from the barrel breech end, or inserting the projectile into the chamber from the muzzle end is physically prohibited; a propellant charge case insertable within the chamber, the propellant charge case comprising: a cylindrical casing body having a forward end, a back end, and a central axis, the casing body enclosing a propellant charge of predetermined amount; a base at the back end of the casing body, the base having a top surface, the base including: a central aperture within the base top surface for receiving a primer or percussion cap, the central aperture extending to the propellant charge; a rim radially extending outwards from the central axis, the rim having a forward surface facing the cylindrical body forward end, the rim forward surface in flush mechanical contact with the barrel breech end when the propellant charge case is inserted within the barrel breech end; a slot or gap located adjacent to, and axially distanced from, the rim forward surface in a direction of the base top surface, such that the slot or gap is exposed outside the barrel breech end when the propellant charge case is inserted within the barrel breech end; and an extractor having an extractor extension, prong, or protrusion, the extractor extension, prong, or protrusion insertable within the slot or gap.

The firearm is a bolt action firearm.

The slot or gap is formed between the rim forward surface and the base top surface, extending radially from the central axis. The top surface may form a disc-shaped cap.

The base includes an axially extending protrusion extending in a direction along the central axis away from the rim forward surface towards the base top surface, the axially extending protrusion terminating at the base top surface.

In a third aspect, the present invention is directed to a bolt action firearm comprising: a bolt action rifle receiver having a bolt; a barrel or barrel extension having a barrel breech end and a muzzle end, the breech end including a slot or gap, such that a propellant charge case of the ammunition loaded within the barrel or barrel extension breech end has a rim with an exposed bottom surface; an extractor attached to, or proximate with, the bolt, the extractor having an extended protrusion for insertion within the slot or gap upon extraction of the propellant charge case.

The bolt action rifle comprises a bolt action muzzleloading rifle.

The extractor is in slideable engagement with respect to the bolt, such that the extractor moves back and forth between a retracted position that allows for full reception of the propellant charge case into the barrel or barrel extension, and an extended position for extracting the propellant charge case.

In a fourth aspect, the present invention is directed to a method of extracting a propellant charge case from a bolt action rifle, comprising: providing a bolt action rifle receiver having a bolt; providing a barrel with a breech end and a muzzle end attached to the receiver; providing a propellant charge case with a casing body and a base having a rim and a gap, the gap being exposed when the propellant charge case is inserted within the barrel breech end with the rim flush against the barrel breech end; providing an extractor attached to, or proximate with, the bolt, wherein the extractor includes a protrusion; inserting the protrusion into the gap; sliding the extractor away from the barrel breech end, which pulls the propellant charge case out of the barrel breech end.

The rim extends radially outwards from a central axis of the propellant charge, the rim having a forward surface facing the barrel muzzle end, the rim forward surface in flush mechanical contact with the barrel breech end prior to extraction.

The step of sliding the extractor away from the barrel breech end includes actuating a bolt action lever in order to pull the bolt away from the breech end of the barrel.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-9 of the drawings in which like numerals refer to like features of the invention.

Figure 1:
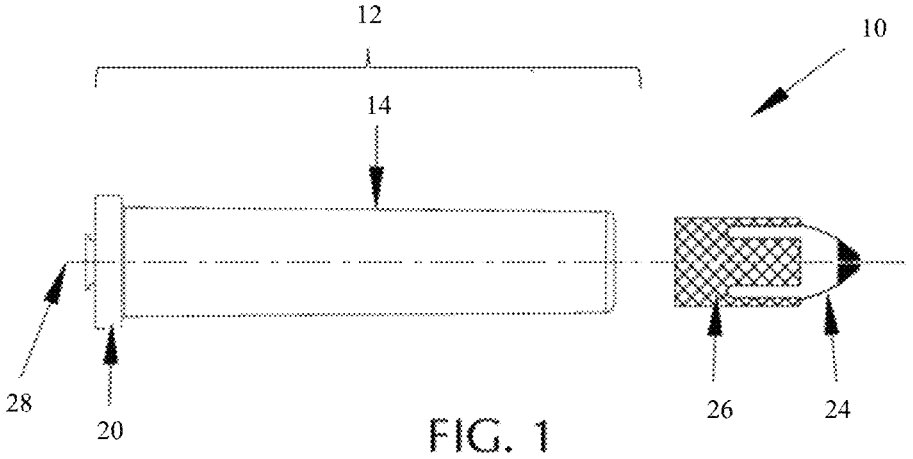
FIG. 1 PRIOR ART
FIG. 1 depicts ammunition components of the prior art, which present a propellant charge including a propellant charge case encasing a propellant therein, a primer, and a saboted projectile.
Figure 2:
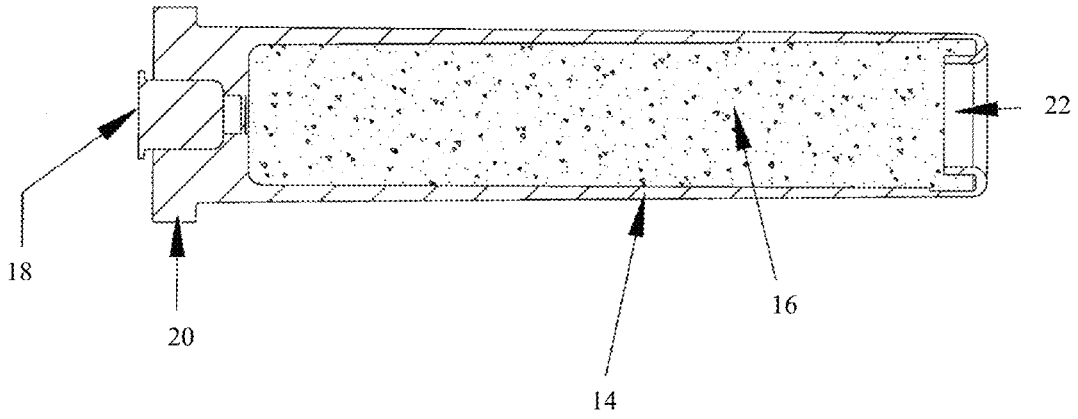
FIG. 2 PRIOR ART
FIG. 2 is a cross-sectional view of the propellant charge case of FIG. 1.

FIGS. 1-2 depict ammunition components 10 of the prior art, which as described herein present a propellant charge 12, which includes a propellant charge case 14 encasing a propellant 16 therein, and primer 18. The propellant charge case 14 is shaped in a hollow cylindrical structure. One end of the propellant charge case 14 has a rim 20 with a diameter larger than that of the propellant charge case diameter. Primer 18 is disposed along the axial center of the rim 20. The inside of the propellant charge case 14 holds the ignitable powder or charged propellant 16, which is sealed within the propellant charge case 14 at one end where the rim 20 and primer 18 are located, and at the other end where cap 22 is located. Cap 22 is disposed proximate the distal end of the propellant charge case 14 opposite the rim 20. Ammunition components 10 further include a bullet or projectile 24, which may include a sabot or gas check 26, wherein the projectile 24 may be axially disposed within the sabot 26 such that they are coaxial along a center longitudinal axis 28. Bullet or projectile 24 may also be used with the muzzleloading rifles of the present invention without a conjoining sabot 26. Projectile 24 and sabot 26 are separate from the propellant charge structure 12, but complete the ammunition component structure 10 when properly loaded into the rifle.

Figure 3:
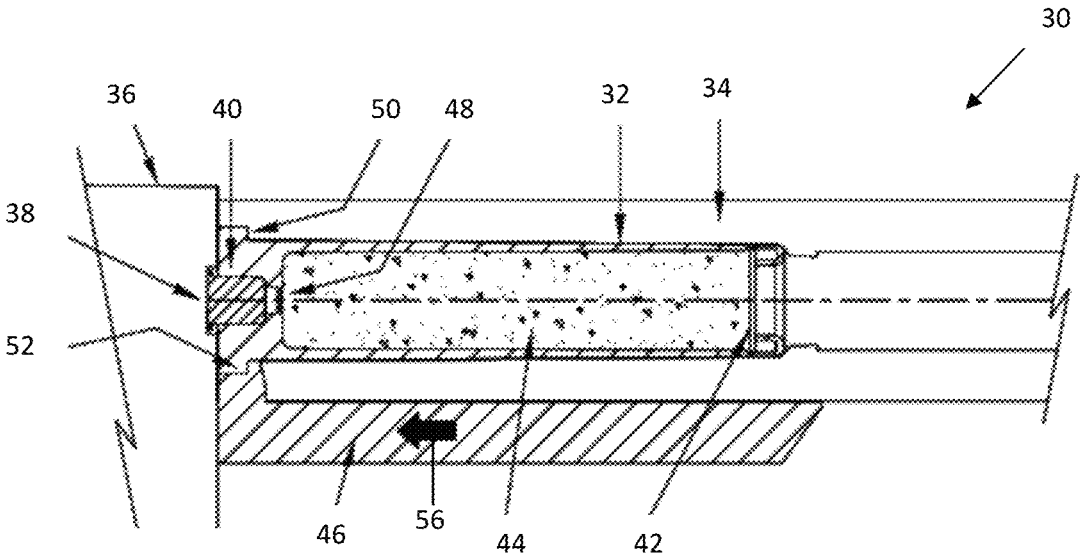
FIG. 3 depicts a cross-sectional partial view of a break open action rifle having a propellant charge case mounted within a barrel chamber.

FIG. 3 depicts a cross-sectional partial view of a break open action rifle 30 having a propellant charge case 32 mounted within a barrel chamber 34. The propellant charge case 32 is fully inserted and seated within the barrel chamber 34, such that there are no exposed areas of the propellant charge case after insertion, save the outermost (top) surface of the rim and top surface of the primer. This is necessary to ensure the propellant charge case does not interfere with the opening and closing of the break open action rifle, and simultaneously prevents the propellant charge case from fracture when excessive gas is presented upon firing. The barrel chamber 34 is closed from the rear or breech end by the receiver 36. The propellant charge case 32 further includes a fulminant or primer 38 housed in a cavity 40 within the rear or breech end of propellant charge case. At the opposite end of the propellant charge case is a cap 42 to secure the propellant charge 44 within the propellant charge case 32. Ejector 46 is depicted with a lip extension for pushing against a portion of the inside circumferential edge of the propellant charge rim that faces the barrel.

There is a conduit 48, extending from the primer to the propellant charge, which may include therein a breakable sealing material capable of puncture, that upon firing directs and communicates the hot gas expelled by primer 38 to the propellant charge 44.

In order to seat the propellant charge case 32 into the barrel chamber 34, as well as facilitate the removal of the propellant charge case, a rim 50 is presented having a circumferential lip with a diameter greater than the cylindrical body diameter of the propellant charge case. Rim 50 is situated on the breech end of the barrel chamber 34, and a step 52 is formed at the breech end of the barrel chamber to ensure precise positioning of the propellant charge.

An innermost portion of rim 50, facing the muzzle end of the barrel, is exposed from the barrel breech end and rests on a lip extension of ejector 46, which, upon break open action, can be shifted in the direction of arrow 56 to extract the spent propellant charge.

An additional constraint on the aforementioned design includes the propellant charge casing normally being built entirely of plastic and expressly designed to fit into the chamber of a break open firearm. As depicted in FIG. 3, since the cartridge is fully inserted in the chamber, there is no portion of the propellant charge case that is exposed for breakage under high gas pressure during firing. In FIG. 3, as shown, the chamber is closed from the rear by the receiver 36 of the rifle. The propellant charge case is effectively "sealed" in the chamber, pressed against step 52 and the lip extension of rim 50. Thus, there is little or no risk of adverse fracture of a plastic case body during firing.

The propellant charge discussed above is designed predominantly for break open action firearms. The design does not serve bolt action rifles for two fundamental reasons: a) the large rear rim on the propellant charge would necessarily require a larger bolt head diameter that would ultimately govern and increase the size of the rifle in order to properly and safely house the charge, and the larger size would not be suitable for sporting activities, such as hunting; and b) the need for extraction would require that the rim be accessible outside of the chamber, which would ultimately expose a portion of the propellant charge.

Figure 4:
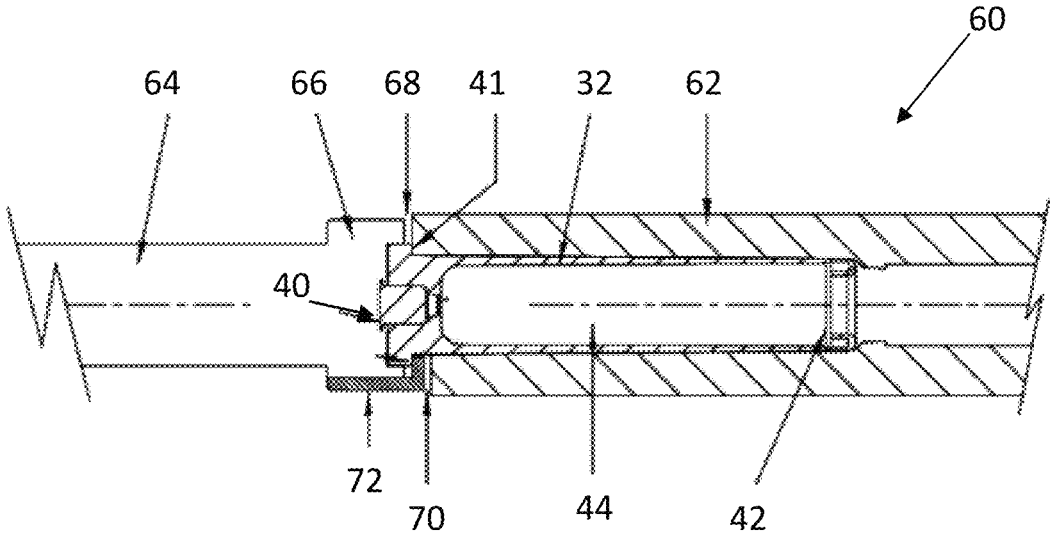
FIG. 4 depicts a partial cross-sectional view of a bolt action rifle receiving the propellant charge case of FIG. 2.

FIG. 4 depicts a partial cross-sectional view of a bolt action rifle 60 receiving the propellant charge case 32. Propellant charge case 32 has propellant charge 44 sealed at one end by cap 42, and a primer cap 40 located at the opposing end. Propellant charge case 32 is seated within the breech end of barrel 62. Bolt 64 with bolt head 66 is shown extended towards barrel 62, securing propellant charge 32 in the barrel chamber. Rim 41 abuts the breech end of barrel 62. A gap 68 is formed between bolt head 66 and the breech end of barrel 62. Similarly, on the opposing side, gap 70 is formed. Gap 70 is necessary to allow for an extractor 72 to make physical contact with a face of rim 41 presenting towards the barrel muzzle end. However, as noted above, the gap exposes a portion of the plastic casing of propellant charge case 32. Thus, utilizing the propellant charge case of this design is not conducive to a bolt action rifle.

Figure 5:
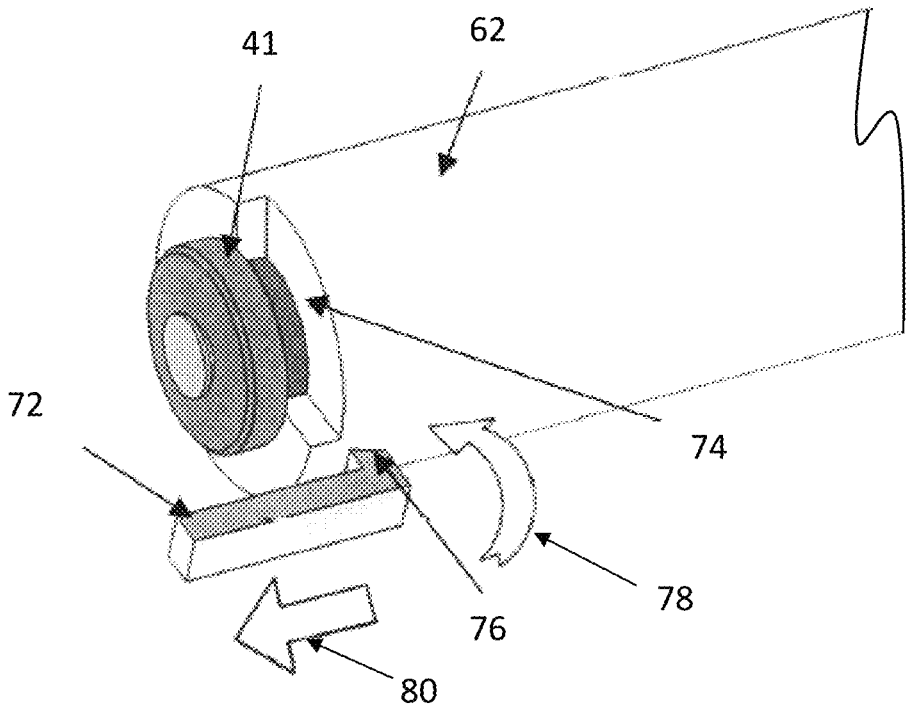
FIG. 5 depicts a partial cross-sectional view of a firearm barrel shown with a gap or notch in the breech end to expose the bottom side of a rim of a propellant charge, and to receive an extended prong or protrusion of an extractor.

As described above, a bolt head/extractor combination will not easily accommodate a flush mounted propellant charge without exposing and requiring a gap for extraction purposes. FIG. 5 depicts a partial cross-sectional view of a modified barrel 62 with a gap or notch 74 in the breech end to expose the muzzle facing side of rim 41 and receives an extension, protrusion, or prong 76 of extractor 72. In order to remove an otherwise flush-mounted propellant charge from the breech end of a barrel extension, the barrel notch 74 permits extractor 72 to move towards the propellant charge, such as by rotation in the direction of arrow 78 between the breech end of barrel 62 and the propellant charge rim 41. When extension 76 is inserted within barrel notch 74, extractor 72 may be moved in the direction of arrow 80, parallel to the axis of the barrel, in order to remove the propellant charge case. This necessitates a predetermined amount of radial clearance for notch 74.

The clearance for barrel notch 74 exposes a portion of propellant charge case 32 to firing pressure, which under certain firing conditions may be capable of breaking the propellant charge case during firing and present unpredictable consequences.

Figure 6:
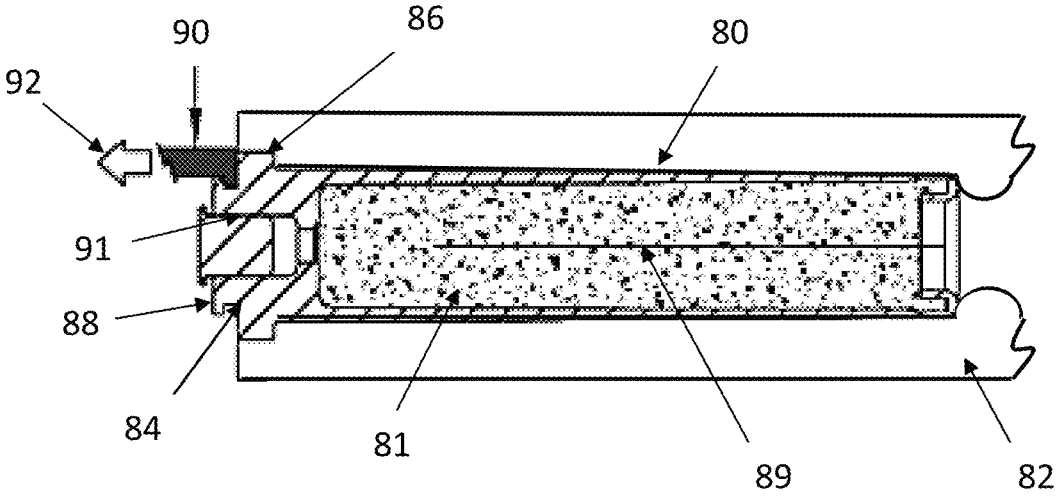
FIG. 6 depicts an embodiment of the present invention, presenting a propellant charge case within a muzzleloading firearm barrel.

FIG. 6 depicts an embodiment of the present invention to mitigate this concern. A propellant charge case 80 is presented within barrel 82 of a muzzleloading firearm. The propellant charge case is insertable within the breech end of the barrel 82. The propellant charge case has a cylindrical casing body with a forward or muzzle-facing end, a back or breech-facing end, which defines the base of the propellant charge case, and a central axis 89. The casing body encloses a propellant charge 81.

At the base of the propellant charge case is a circular disc or rim 86 that extends radially outwards from central axis 89 and beyond the diameter of the cylindrical casing body. In this manner, rim 86 has a larger diameter than the propellant charge case diameter. A protrusion 84, preferably a cylindrical protrusion extending outwardly from the rim in the breech direction, is centrally positioned on the rim top surface and is projected axially away from rim 86, terminating in a top disc 88, generally in the form of a flat, circular disc extending radially outwards with a diameter slightly larger than the diameter of cylindrical protrusion 84. This formation presents an extraction receiving gap, such as a slot or hole (preferably, but not limited to, a circumferential slot), between the top disc 88 and the top surface of the rim 86. The extraction gap is configured to receive an extractor 90.

This design allows for rim 86 to seat flush within a stepped portion at the breech end of barrel 82 in a bolt action firearm. Upon extraction, extractor 90 is placed within the extraction gap 84 and retracted axially in the direction of arrow 92 to pull propellant charge case 80 from barrel 82.

A central aperture or cavity 91, axially centered about central axis 89, receives a primer or percussion cap 85.

Top surface disc 88 of cylindrical extension 84 is of an appreciably smaller diameter than the rim of the prior art propellant charge case. This diameter matches that of some commonly used cartridges on the market so that the bolt of a bolt action rifle, and with its associated bolt head, can be of an industry-standard diameter, and therefore, advantageously, the size of the muzzleloader bolt action rifle will not be bigger than most common models on the market.

As noted above, the present invention may be implemented in a bolt action muzzleloading firearm to facilitate the extraction of a propellant charge case. The bolt action muzzleloading firearm is preferably designed with a barrel having a breech end modified to include a chamber at the breech end adapted to accept a propellant charge case of the present invention, or adaptable to a barrel extension at the breech end of the barrel, where the barrel extension is modified to include a similar chamber.

The chamber receives the propellant charge case, wherein the chamber extends through the barrel breech end (or barrel extension breech end) to a narrowing portion in the barrel.

The narrowing portion having a smaller diameter than a largest diameter of a projectile inserted in the muzzle end of the barrel, such that loading the projectile into the barrel from the barrel breech end or inserting the projectile into the chamber from the muzzle end is physically prohibited.

The propellant charge case used in the bolt action muzzle-loading firearm is insertable within the chamber. It has a cylindrical casing body with a forward end, a back end, and a central axis, and encapsulates a propellant charge of a predetermined amount.

At the back end of the propellant charge casing body is the base, which presents an exposed top surface and includes an axially located central cavity that extends from the base top surface to the encapsulated propellant charge. The central cavity is configured with a diameter for receiving a primer or percussion cap.

In one embodiment, the base of the propellant charge casing further includes a rim radially extending outwards from the central axis. The rim has a forward surface with a face exposed in the direction of the muzzle end of the firearm. The propellant charge case is inserted into the chamber such that the rim's forward surface face is flush against the breech end of a barrel or a barrel extension.

As noted above, a gap is formed adjacent to, and axially distanced from, the rim forward breech-exposed surface in a direction of the base top surface, such that the gap is exposed outside the barrel breech end when the propellant charge case is inserted within said barrel breech end. In at least one embodiment, the gap is a formed slot. In another embodiment, the slot is circumferentially exposed.

The bolt action muzzleloading firearm includes an extractor having an extractor extension, prong, or protrusion, located preferably on the bolt, on or proximate to the bolt head. The extractor is removably insertable within the slot, such that after firing, upon movement of the bolt away from the barrel breech end, the extractor pulls the propellant charge case out of the breech end of the barrel.

Figure 7:
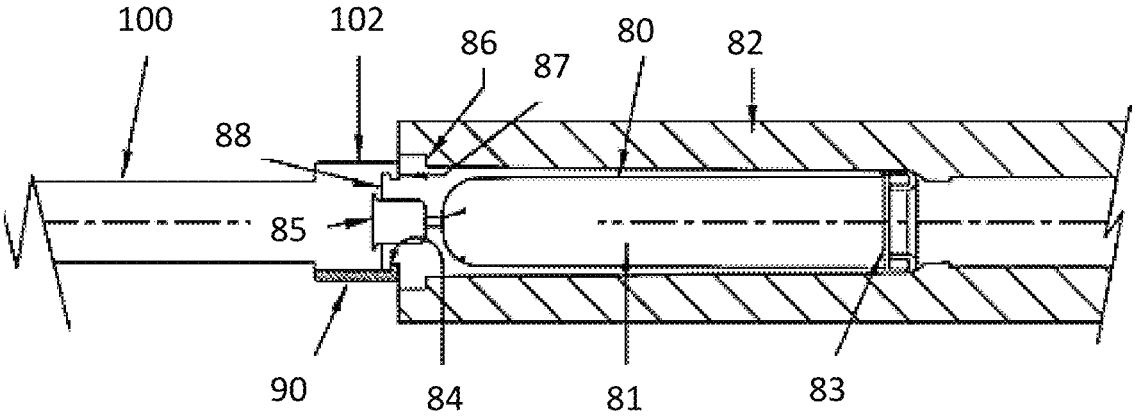
FIG. 7 depicts a partial cross-sectional view of the embodiment of FIG. 6, showing a bolt with a bolt head secured against the breech end of the bolt action firearm barrel and propellant charge case.

FIG. 7 depicts a partial cross-sectional view of the embodiment of FIG. 6, showing a bolt 100 with bolt head 102 secured against barrel 82 and propellant charge case 80. Propellant charge case 80 securing a propellant charge 81 secured by a cap 83 at one end, and a primer 85 at the other. As depicted, bolt head 102 is positioned flush with the breech end of barrel 82 at the top portion 87 of rim 86. Extractor 90 is insertable within extraction slot 84 formed between disc 88 and rim 86. Extractor 90 may be resiliently attached to the bolt head.

In one embodiment, bolt head 102 includes small extractor therein, which has a radially extending prong to fit into extractor slot or perimeter groove 84. In this manner, even by rotating the bolt and the extractor contained therein, the propellant charge case is never exposed outside the barrel. The rim sits flush against the breech end of the barrel, and the region of the propellant charge case most exposed to pressure is now supported by the walls of the barrel.

Figure 8:
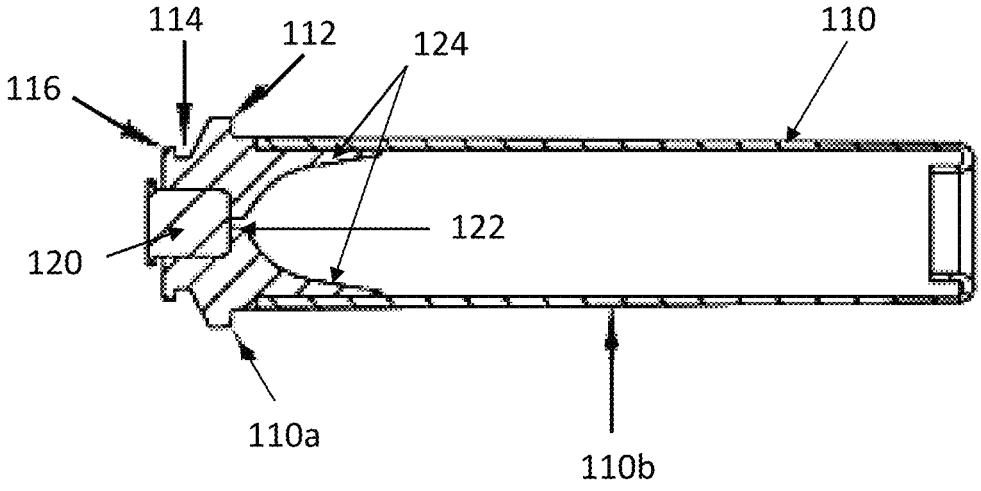
FIG. 8 depicts another embodiment of a propellant charge case of the present invention, which includes a reinforced version of the propellant charge case of FIG. 6.

FIG. 8 depicts another embodiment of a propellant charge case of the present invention. This embodiment reflects a reinforced version of the propellant charge case of FIG. 6. In this embodiment, at least a portion 110*a* of the propellant charge case 110 is constructed of metal, and a portion 110*b* is constructed of reinforced plastic.

This metal area 110*a* has a rim 112, a cylindrical extension 114 extending axially from rim 112, and a top, radially extending disc 116 that, together wih the surface of the rim, form an extraction slot for receiving an extractor (not shown).

In the center of metal area 110*a* is an accommodation for primer 120 that communicates through a small hole 122 and sealed with a fine sheet of plastic material. This metal region 110*a* has an insert that narrows forward 124. The front of the plastic-made propellant charge case 110*b* is fixed upon it. At the breech end of the propellant charge case 110, plastic wraps around and is fixed upon the metal insert 124.

Figure 9:
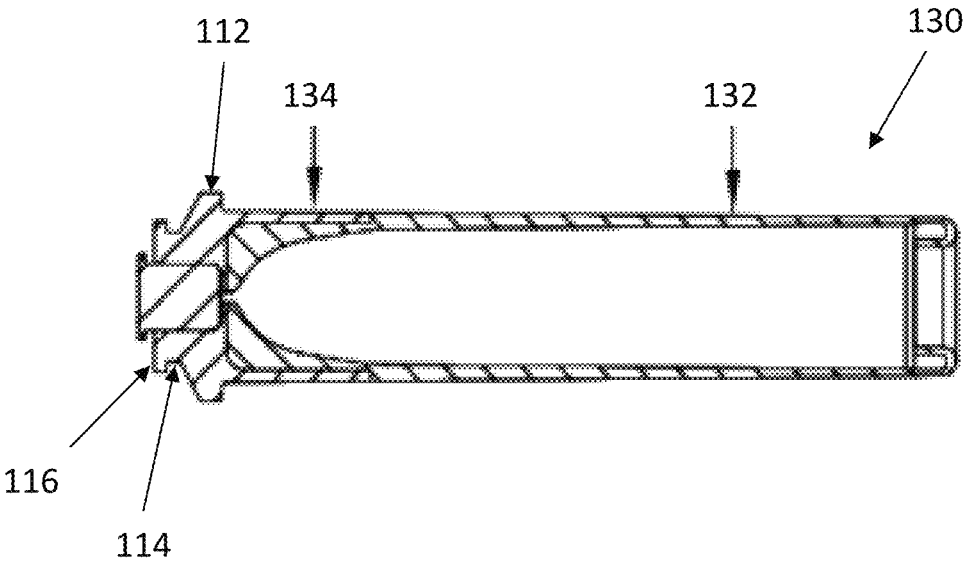
FIG. 9 depicts a variant of the propellant charge case of FIG. 8, where the plastic body of the case is at least partially coated with metal.

In yet another embodiment of the propellant charge case of the present invention, FIG. 9 depicts a variant of the propellant charge case 130 where the plastic body 132 of the case is coated with metal 134. That is, the metal portion forms the cylindrical tubing that surrounds and forms the breech end of the propellant charge case. This version is a variant of the previous one in which the plastic body of the propellant charge case, instead of coating the metal, is coated by the metal.

In this model, the sealing of the fire communication duct from the percussion cap or primer to the propellant charge is performed by the same plastic of the cartridge body, and does not require any additional components.

It should be noted that the partial metal casing of the propellant charge case discussed above can be utilized in a propellant charge case design such as that depicted in FIG. 5, where otherwise exposed plastic may be replaced or hardened with exposed metal.

In another aspect, a method of extracting the propellant charge case of the present invention from a muzzleloading rifle is presented. A muzzleloading rifle receiver having a barrel with a breech end and a muzzle end is presented with a propellant charge case inserted in the barrel breech end such that the rim of the propellant charge case is flush against the barrel breech end. After firing, a portion of an extractor, such as an extended protrusion, extension, or prong of the extractor, is inserted into a slot between a cutout portion of the barrel breech end and the propellant charge case rim, or a gap formed on the top of the propellant charge case rim by a disc cap and a cylindrical protrusion extending from the rim. The extractor, which is preferably located on or proximate to the end of the bolt in a bolt action rifle, slides away from the barrel breech end with the extraction of the bolt, which pulls the propellant charge case out of the barrel breech end.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A propellant charge case for ammunition for a muzzle-loading firearm having a barrel or barrel extension with a breech end and a muzzle end, said propellant charge case having a two-piece construction comprising:

a cylindrical casing body having a forward end, a back end, and a central axis, said casing for insertion within said breech end of said barrel or barrel extension, said casing body enclosing a propellant charge of predetermined amount, and a cap proximate said forward end of said casing body for sealing said propellant charge within said propellant charge case;

wherein the cap is configured to rupture or burst when the propellant charge is ignited; and a base at the back end of said casing body, said base having a top surface and a bottom surface, said base including:

a cylindrical cavity receiving a primer or percussion cap;

a central aperture extending from said cylindrical cavity to said propellant charge;

an insert portion including a forward narrow portion, a portion of said insert portion inserted within said casing body;

a rim radially extending outwards from said central axis, said rim having a forward surface facing said cylindrical body forward end, said rim forward surface in contact with said barrel breech end or barrel extension breech end when said propellant charge case is inserted within said barrel breech end or said barrel extension breech end; and a gap located adjacent to, and axially distanced from, said rim forward surface in a direction of said base top surface, such that said gap is exposed outside said breech end or said barrel extension breech end when said propellant charge case is inserted within said barrel breech end or said barrel extension breech end;

wherein said gap is configured to receive an extractor.

2. The propellant charge case of claim 1, wherein said gap is formed between said rim forward surface and a disc extending radially from said central axis.

3. The propellant charge case of claim 2 wherein said disc is formed at said base top surface.

4. The propellant charge case of claim 2, wherein said base includes an axially extending protrusion extending in a direction along said central axis away from said rim forward surface towards said base top surface, said axially extending protrusion terminating at said disc such that said gap is a circumferential slot.

5. The propellant charge case of claim 4 wherein said base axially extending protrusion has a diameter that is smaller than a diameter of said rim and smaller than a diameter of said disc, forming said slot.

6. The propellant charge case of claim 4, wherein said base axially extending protrusion is a cylindrical body.

7. The propellant charge case of claim 1 wherein said gap is configured to receive an extractor for removing said propellant charge case from said barrel breech end or said barrel extension breech end.

8. The propellant charge case of claim 1 including having said cylindrical casing body fabricated of plastic material.

9. The propellant charge case of claim 1 wherein said gap is formed circumferentially around said base, centered about said central axis.

10. The propellant charge case of claim 1 including a metal outer surface on at least a portion of said cylindrical casing body.

11. The propellant charge case of claim 1 wherein said muzzleloading firearm is a bolt action firearm.

12. A firearm and ammunition combination comprising:

a rifle receiver;

a barrel having a barrel breech end and a muzzle end, said muzzle end configured for receiving a projectile;

said barrel breech end having a chamber to receive a cartridge or propellant charge case, wherein the chamber extends through the barrel breech end to a narrowing portion in the barrel, said narrowing portion having a smaller diameter than a largest diameter of said projectile, such that loading said projectile into the barrel from said barrel breech end, or inserting said projectile into said chamber from said muzzle end is physically prohibited;

a propellant charge case insertable within said chamber, said propellant charge case having a two-piece construction comprising:

a cylindrical casing body having a forward end, a back end, and a central axis, said casing body enclosing a propellant charge of predetermined amount; and a base at the back end of said casing body, said base having a top surface, said base including:

a central aperture within said base top surface for receiving a primer or percussion cap, said central aperture extending to said propellant charge;

an insert portion including a forward narrow portion, a portion of said insert portion inserted within said casing body;

a rim radially extending outwards from said central axis, said rim having a forward surface facing said cylindrical body forward end, said rim forward surface in flush mechanical contact with said barrel breech end when said propellant charge case is inserted within said barrel breech end;

a slot or gap located adjacent to, and axially distanced from, said rim forward surface in a direction of said base top surface, such that said slot or gap is exposed outside said barrel breech end when said propellant charge case is inserted within said barrel breech end; and an extractor having an extractor extension, prong, or protrusion, said extractor extension, prong, or protrusion insertable within said slot or gap.

13. The firearm and ammunition combination of claim 12, wherein said slot or gap is formed between said rim forward surface and said base top surface, extending radially from said central axis.

14. The firearm and ammunition combination of claim 13, wherein said top surface forms a disc-shaped cap.

15. The firearm and ammunition combination of claim 13, wherein said base includes an axially extending protrusion extending in a direction along said central axis away from said rim forward surface towards said base top surface, said axially extending protrusion terminating at said base top surface.

16. The firearm and ammunition combination of claim 12, wherein said firearm is a bolt action firearm.

17. A projectile-less propellant charge case for ammunition for a muzzleloading firearm having a barrel or barrel extension with a breech end and a muzzle end, said propellant charge case comprising:

a cylindrical casing body having a forward end, a back end, and a central axis, said casing for insertion within said breech end of said barrel or barrel extension, said casing body enclosing a propellant charge of predetermined amount;

a cap proximate said forward end of said casing body for sealing said propellant charge within said propellant charge case;

wherein the cap is configured to rupture or burst when the propellant charge is ignited;

a base at the back end of said casing body, said base having a top surface and a bottom surface, said base including:

a cylindrical cavity receiving a primer or percussion cap;

a central aperture extending from said cylindrical cavity to said propellant charge;

a rim radially extending outwards from said central axis, said rim having a forward surface facing said cylindrical body forward end, said rim forward surface in contact with said barrel breech end or barrel extension breech end when said propellant charge case is inserted within said barrel breech end or said barrel extension breech end; and a gap located adjacent to, and axially distanced from, said rim forward surface in a direction of said base top surface, such that said gap is exposed outside said breech end or said barrel extension breech end when said propellant charge case is inserted within said barrel breech end or said barrel extension breech end;

wherein said gap is configured to receive an extractor.

* * * * *